United States Patent [19]

Capelli

[11] 3,958,715

[45] May 25, 1976

[54] PARTITIONED VENTILATED CLOTHES HAMPER

[75] Inventor: John J. Capelli, Brooklyn, N.Y.

[73] Assignee: Lawrence Peska Associates, Inc., New York, N.Y. ; a part interest

[22] Filed: Oct. 6, 1975

[21] Appl. No.: 620,169

[52] U.S. Cl. ..... 220/22; 220/20.5

[51] Int. Cl.[2] ..... B65D 1/24

[58] Field of Search ..... 220/22, 22.3, 20.5, 220/367; 312/211

[56] References Cited

UNITED STATES PATENTS

| | | | |
|---|---|---|---|
| 2,796,309 | 6/1957 | Taylor | 312/211 |
| 3,692,204 | 9/1972 | Provi et al. | 220/4 F |
| 3,759,412 | 9/1973 | Bush | 220/4 F X |

*Primary Examiner*—William Price
*Assistant Examiner*—Steven M. Pollard

[57] ABSTRACT

A clothes hamper having a hollow foraminous interior partition extending lengthwise of the hamper to form a pair of compartments. The cover is formed with a plurality of openings and the bottom wall is foraminous and supported in spaced relation to the supporting surface for the hamper. Circulation of air through the hamper is thus provided.

4 Claims, 4 Drawing Figures

PARTITIONED VENTILATED CLOTHES HAMPER

BACKGROUND OF THE INVENTION

The present invention relates to clothes hampers and more particularly to a partitioned, ventilated clothes hamper.

It is old in the art of clothes hamper construction to provide separate compartments in the interior for the separate storage of different articles of soiled laundry. Thus, U.S. Pat. No. 2,814,542 issued Nov. 26, 1957 to H. Gleitsman teaches the provision of upper and lower separate article compartments. U.S. Pat. No. 2,625,973 issued Jan. 20, 1953 to J. J. Weldon et al discloses a laundry hamper in which a plurality of laundry bags are arranged within a rectangular frame. Thus, it was appreciated heretofore that the separate storage in a clothes hamper of various types of articles was desirable. However, it frequently happens that damp articles such as was cloths, towels and the like must be stored in the hamper. The storage of such damp articles in a closed receptacle for prolonged periods of time of the order of days or as much as a week, which is not at all uncommon, leads to the creation of mildew conditions and a musty odor in the general area where the clothes hamper is stored. It would, therefore, be advantageous to provide a hamper construction which not only enables the separate storage of different articles of laundry but also the separate storage of dry and damp articles of laundry.

SUMMARY OF THE INVENTION

It is one object of the invention to provide a clothes hamper which affords the separate storage of different articles of laundry and which is ventilated so as to avoid the creation of mildew conditions.

It is another object of the invention to provide a clothes hamper which is ventilated and is constructed interiorly so as to provide for either the separate compartmentalized storage of laundry articles or the bulk storage of same.

Other objects and advantages of the invention will become readily apparent from the following description of the invention.

In accordance with the present invention there is provided a partitioned ventilated clothes hamper comprising: an open-top elongated receptacle; a cover pivotally connected to the receptacle so as to be pivotable between a first closed position where the open top of the receptacle is covered and a second open position where access is provided to the interior of the receptacle; and a hollow foraminous partition extending lengthwise within the receptacle to thereby divide the receptacle into separate compartments.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figure 1:
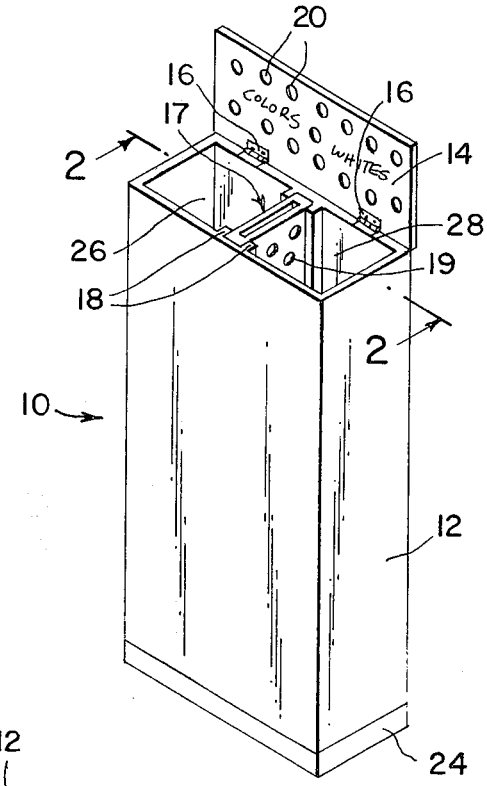
FIG. 1 is a front perspective view of a clothes hamper constructed in accordance with the invention.
Figure 3A:
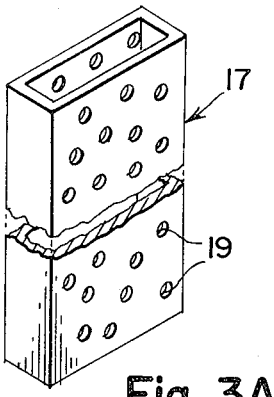
FIG. 3A is a pictorial representations of the hollow partition.
Figure 3:
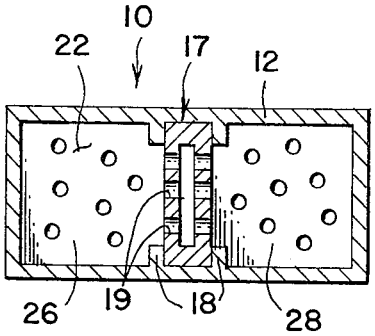
FIG. 3 is a plan view of the clothes hamper of FIG. 2, partly in section, taken along line 3—3 thereof.
Figure 2:
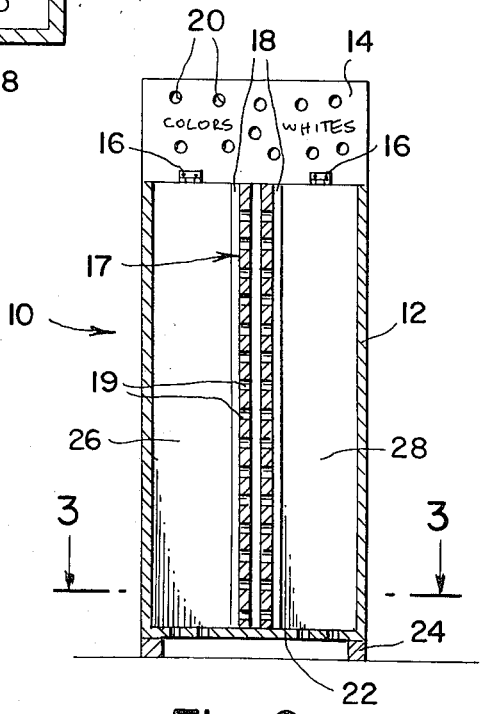
FIG. 2 is a front elevational view of the clothes hamper shown in FIG. 1, partly in section, taken along line 2—2 thereof.

Referring to the drawings there is shown generally by numeral 10 a clothes hamper. The hamper comprises an elongated receptacle 12 one end of which has an open top. A cover 14 is pivotally connected as by hinges 16 to the receptacle so as to be pivotable between an open position as shown in FIGS. 1 and 2 and a closed position in which the cover is seated upon the top surface of the receptacle to thereby prevent access to its interior.

At least one hollow foraminous partition 17 having a plurality of apertures 19 is positioned within the receptacle lengthwise to thereby divide the interior of the receptacle into as many compartments as is desired. As shown in the drawings, only a single partition dividing the receptacle into two separate compartments 26, 28 is provided. It will be understood, however, that two or even more of such partitions may be provided. Desirably the partitions are secured in place by being positioned within opposed tracks or guides 18 which extend lengthwise of the receptacle. Preferably the partitions may slide into place within the tracks so as to be removable when desired so that the articles of laundry may be stored in bulk.

The cover for the hamper is formed with a plurality of through openings 20 for a purpose to be subsequently described.

The bottom wall 22 of the receptacle is desirably foraminous in the same manner as partition 17. Beneath the periphery of the bottom wall there is secured a base member 24 upon which the hamper rests. This construction is of special value with a hamper that is provided with a foraminous bottom wall since it affords support of the hamper with the bottom wall spaced from the floor or other supporting surface for the hamper.

The provision of the hollow foraminous partition 17 and the openings 20 in the cover 14, coupled with the foraminous bottom wall, provide for the circulation of air upwardly through the hamper to reduce the condition of dampness which may exist within the hamper thereby eliminating or at least substantially minimizing the development and accumulation of odors and mildew.

It will thus be seen that by the construction of this invention a ventilated hamper has been provided which may, when desired, be compartmentalized for the separate storage of different classes or categories of laundry articles.

What is claimed is:

1. A partitioned ventilated clothes hamper comprising:

an open-top elongated receptacle;

a cover pivotally connected to said receptacle so as to be pivotable between a first closed position where the open top of the receptacle is covered and a second open position where access is provided to the interior of the receptacle;

and a hollow foraminous partition extending lengthwise within the receptacle to thereby divide the receptacle into separate compartments.

2. A clothes hamper according to claim 1, wherein said partition is removably positioned within said receptacle.

3. A clothes hamper according to claim 1, including a plurality of through openings formed in said cover.

4. A clothes hamper according to claim 3, including a foraminous bottom wall for said receptacle and a base member underlying the periphery of said bottom wall whereby said bottom wall is spaced from the supporting surface for the hamper to provide for circulation of air from beneath the hamper through the bottom wall upwardly through said hollow partition and out of the openings in the cover.

* * * * *